US012004564B2

(12) United States Patent
Steinbauer et al.

(10) Patent No.: US 12,004,564 B2
(45) Date of Patent: Jun. 11, 2024

(54) VAPORIZER CARTRIDGE

(71) Applicants: Martin Steinbauer, New York, NY (US); Andrew Ryan, Boston, MA (US)

(72) Inventors: Martin Steinbauer, New York, NY (US); Andrew Ryan, Boston, MA (US)

(73) Assignee: LOFT LABS, LLC, New York, NY (US)

( * ) Notice: Subject to any disclaimer, the term of this patent is extended or adjusted under 35 U.S.C. 154(b) by 371 days.

(21) Appl. No.: 17/499,326

(22) PCT Filed: Apr. 13, 2020

(86) PCT No.: PCT/US2020/027978

§ 371 (c)(1),
(2) Date: Oct. 12, 2021

(87) PCT Pub. No.: WO2020/210821

PCT Pub. Date: Oct. 15, 2020

(65) Prior Publication Data

US 2022/0087319 A1 Mar. 24, 2022

Related U.S. Application Data

(60) Provisional application No. 62/833,299, filed on Apr. 12, 2019.

(51) Int. Cl.
*A24F 40/42* (2020.01)
*A24F 40/44* (2020.01)
(Continued)

(52) U.S. Cl.
CPC ..... *A24F 40/42* (2020.01); *A24F 40/44* (2020.01); *A24F 40/485* (2020.01); *A24F 40/70* (2020.01)

(58) Field of Classification Search
CPC ..... A24F 40/42; A24F 40/70; A24F 40/485; A24F 40/44
See application file for complete search history.

(56) References Cited

U.S. PATENT DOCUMENTS 10,357,064 B1 7/2019 Kleizo et al.
2017/0086507 A1 3/2017 Rado
(Continued)

FOREIGN PATENT DOCUMENTS

WO 2019038521 A1 2/2019

OTHER PUBLICATIONS

The International Search Report and Written Opinion, dated Jul. 16, 2020, in the corresponding PCT Appl. No. PCT/US2020/027978.
(Continued)

*Primary Examiner* — Christopher M Rodd
*Assistant Examiner* — Jennifer A Kessie
(74) *Attorney, Agent, or Firm* — Caldwell Intellectual Property Law

(57) ABSTRACT

A vaporizer cartridge includes: 1) a body including a storage compartment configured to hold a vaporizable material, the body having a first end and a second end opposite the first end, the body having a mouthpiece positioned at the first end and the second end being configured for insertion into a receptacle of the vaporizer device, 2) a heating chamber including a heating element configured to vaporize the vaporizable material, 3) a vapor tube extending between the heating element and the mouthpiece, 4) a seal insertable at the second end within the storage compartment of the body, the seal configured to retain the vaporizable material within the storage compartment and including a well for retaining the heating element and interior surfaces inclined from a distal end of the seal toward the well for funneling the flow of the vaporizable material within the storage compartment
(Continued)

towards the well, and 5) a cap insertable at the second end for retaining the seal within the storage compartment.

14 Claims, 20 Drawing Sheets

(51) Int. Cl.
*A24F 40/485* (2020.01)
*A24F 40/70* (2020.01)

(56) References Cited

U.S. PATENT DOCUMENTS

| | | | | |
|---|---|---|---|---|
| 2017/0215479 | A1 | 8/2017 | Kies | |
| 2017/0280778 | A1 | 10/2017 | Force | |
| 2018/0007961 | A1 | 1/2018 | Zhu | |
| 2019/0083720 | A1* | 3/2019 | Leadley | A24F 40/485 |
| 2019/0159524 | A1* | 5/2019 | Qiu | A24F 40/485 |
| 2019/0297946 | A1 | 10/2019 | Fu et al. | |
| 2019/0350259 | A1 | 11/2019 | Ouyang | |
| 2020/0367556 | A1 | 11/2020 | Lin et al. | |
| 2022/0007724 | A1 | 1/2022 | Zhang et al. | |

OTHER PUBLICATIONS

The extended European search report, dated Nov. 25, 2022, in the related European Appl. No. 20788574.0.

* cited by examiner

VAPORIZER CARTRIDGE

CROSS-REFERENCE TO RELATED APPLICATION

This application is a National Stage Application of PCT/US20/27978, entitled "Vaporizer Cartridge," and filed on Apr. 13, 2020" claiming priority under 35 U.S.C. § 119(e) to U.S. Provisional Patent Application No. 62/833,299, entitled "Vaporizer Cartridge," filed on Apr. 12, 2019. Each of these two applications is hereby incorporated by reference herein in its entirety.

FIELD OF THE INVENTION

This disclosure relates generally to vaporizer cartridges, and more particularly, to vaporizer cartridges having a distributed support feature for insertion into a vaporization device and an internal seal system for directing fluid flows.

BACKGROUND

Previous inventors have attempted to secure cartridges by creating an indent in the cartridge at the bottom of the cartridge that can couple with an extrusion at the mating region of the battery. Furthermore, magnets have been used to secure cartridges into the mating region. However, both approaches create the problem that the cartridge does not have enough support towards the mouthpiece end, creating the sense the cartridge is not inserted properly or the cartridge is inserted loosely. Such instability may also impact the reliability of the electrical contacts.

Liquid funnel acts as funneling the liquid held in the vaporizer cartridge towards the heating chamber. Previously constructions have not addressed some liquid not reaching the heating element of a cartridge, creating pools of liquid the user could not access or utilize. Further, the liquid funnel acts as a seal that controls the flow of liquid from the reservoir to the chamber. Instead, constructions have relied on wicks to access liquids to the heating element which often resulted in uncontrolled flows (not enough liquid, too much liquid.

Further, currently vapor tubes are often directly above heating elements with either no or extra sealing pieces. Thus, excess liquid may travel further up the vapor tube and seep out of the mouth hole.

Previous constructions have relied on molding the housing of a cartridge covered by a cosmetic mouthpiece. This introduced a further manufacturing step and additional components. Further, cartridges have relied on a viewing window created by either imprinting a window shape or by creating a window shape upon insertion of the cartridge into the vaporizer body.

It would be beneficial to develop a vaporizer cartridge that addresses these deficiencies.

SUMMARY

By way of example, aspects of the present disclosure are directed to disclose a novel vaporizer cartridge.

In accordance with aspects of the present disclosure, the disclosed vaporizer cartridge includes: 1) a body including a storage compartment configured to hold a vaporizable material, the body having a first end and a second end opposite the first end, the body having a mouthpiece positioned at the first end and the second end being configured for insertion into a receptacle of the vaporizer device, 2) a heating chamber including a heating element configured to vaporize the vaporizable material, 3) a vapor tube extending between the heating element and the mouthpiece, 4) a seal insertable at the second end within the storage compartment of the body, the seal configured to retain the vaporizable material within the storage compartment and including a well for retaining the heating element and interior surfaces inclined from a distal end of the seal toward the well for funneling the flow of the vaporizable material within the storage compartment towards the well, and 5) a cap insertable at the second end for retaining the seal within the storage compartment.

In accordance with an additional aspect of the disclosure, 1) the second end of the body has a rectangular cross-section externally bounded by two opposing side surfaces, a front surface and a rear surface, 2) each of the two opposing side surfaces further comprises a stabilizing extrusion extending outwardly from the surface at a proximal end of the second end of the body, 3) at least one of the front surface or rear surface has a plurality of stabilizing extrusions extending outwardly from the front or rear surface and 4) the stabilizing extrusions are configured for stably positioning the body in the receptacle of the vaporizer device.

This SUMMARY is provided to briefly identify some aspects of the present disclosure that are further described below in the DESCRIPTION. This SUMMARY is not intended to identify key or essential features of the present disclosure nor is it intended to limit the scope of any claims.

BRIEF DESCRIPTION OF THE DRAWING

A more complete understanding of the present disclosure may be realized by reference to the accompanying drawing in which.

DETAILED DESCRIPTION

The following merely illustrates the principles of the disclosure. It will thus be appreciated that those skilled in the art will be able to devise various arrangements which, although not explicitly described or shown herein, embody the principles of the disclosure and are included within its spirit and scope.

Furthermore, all examples and conditional language recited herein are principally intended expressly to be only for pedagogical purposes to aid the reader in understanding the principles of the disclosure and the concepts contributed by the inventor(s) to furthering the art, and are to be construed as being without limitation to such specifically recited examples and conditions.

Moreover, all statements herein reciting principles, aspects, and embodiments of the disclosure, as well as specific examples thereof, are intended to encompass both structural and functional equivalents thereof. Additionally, it is intended that such equivalents include both currently known equivalents as well as equivalents developed in the future, i.e., any elements later developed that perform the same function, regardless of structure.

Unless otherwise explicitly specified herein, the drawings are not drawn to scale.

Aspects of the present disclosure are directed to a novel vaporizer cartridge. The cartridge features a leak resistant construction, insertable into a battery housing. The user of the construction would inhale through the cartridge, triggering a pressure sensor activated process that heats the liquid filled into the aforementioned cartridge, to generate an aerosol.

Figure 1:
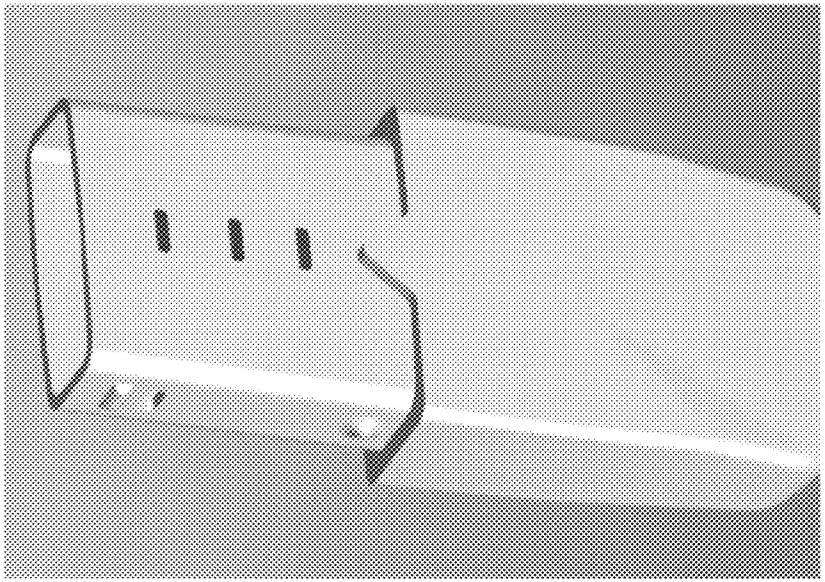
FIG. 1 illustrates a vaporizer cartridge according to aspects of the present disclosure.

The cartridge preferable has extrusions towards the sides of the cartridge aimed to both stabilize and secure a cartridge at the region where the side of the cartridge meets the device receptacle as well as at a region further north of the receptacle. This may be achieved by the extrusions on the cartridge passing by the extrusions on the receptacle region of the battery. In addition or instead of extrusions, locking gaps may be added in the receptacle region of the battery at any place in the receptacle region. Embodiments may introduce further stabilizing features at same or different intervals. The construction will allow the cartridge to be inserted and detached securely. The support received both at the bottom and at the top stabilizers allows the cartridge to be supported at both regions. Bottom and top stabilizers are positioned along sides of the cartridge/pod as illustrated in FIG. 1.

Figure 2A:
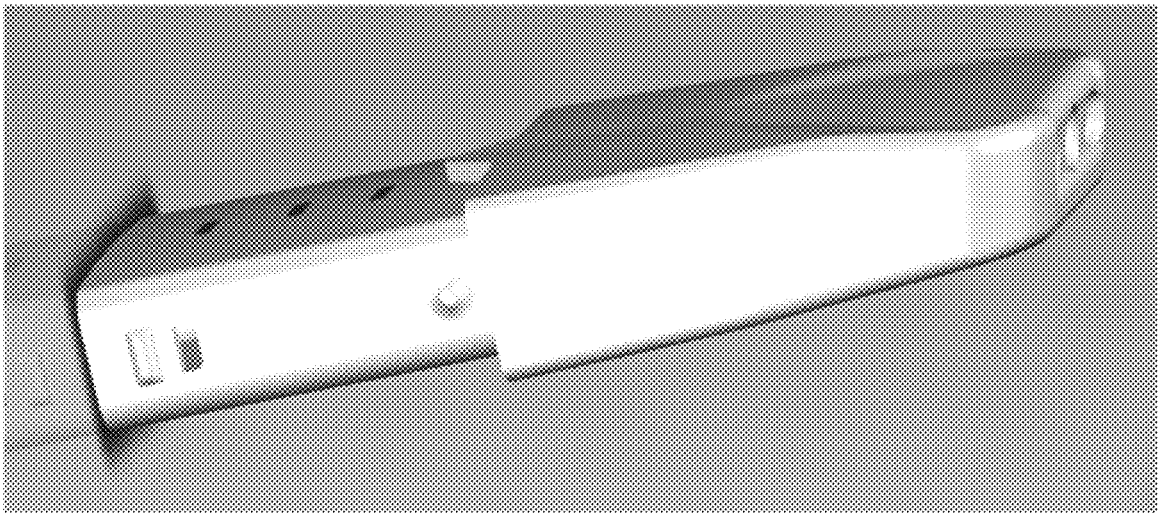
FIGS. 2A-2D illustrate additional aspects of the vaporizer cartridge according to aspects of the present disclosure.
Figure 2B:
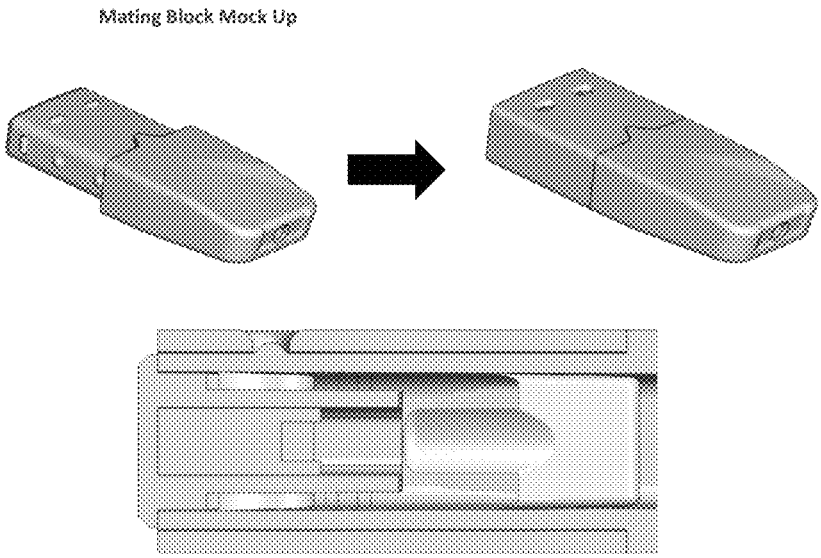

Furthermore, the three extrusions on one side of the cartridge provide additional support and a tactile guide for the user to insert the cartridge orienting the tapered mouthpiece and the elongated tip upwards (see, e.g. the three extrusions shown on an upper surface of the cartridge in FIG. 2A). FIG. 2B illustrates how the mating region could interact with the cartridge extrusions. FIG. 2B present an alternate arrangement of tactical guides as compared to FIG. 1, One of skill in the art will recognize that the disclosure contemplates any number of configurations including one or more guides, perhaps presumptively disposed in a symmetry that is tactically identifiable and positionally supports the cartridge/pod within the device.

Figure 2C:
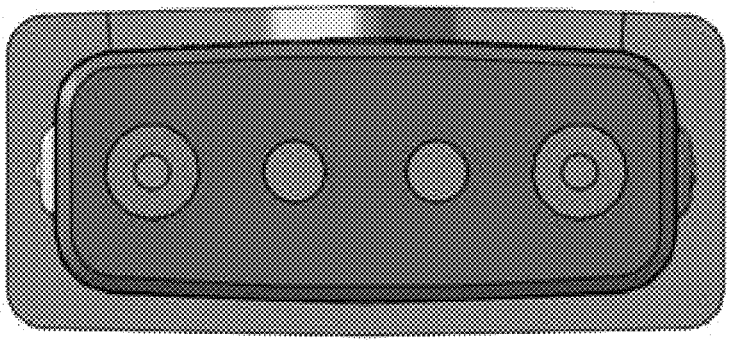

Furthermore, securely attaching a cartridge to the vaporizer receptacle may include one or magnets. The magnet further guides the user in securely attaching the cartridge. In the embodiment of bottom air holes, ring magnets may further be used. Ring magnets would be inserted at the point where the air holes are situated, and can be placed around them. This solution may save space in a small area and avoid added complexity in the molding process (see, e.g., FIG. 2C).

Figure 2D:
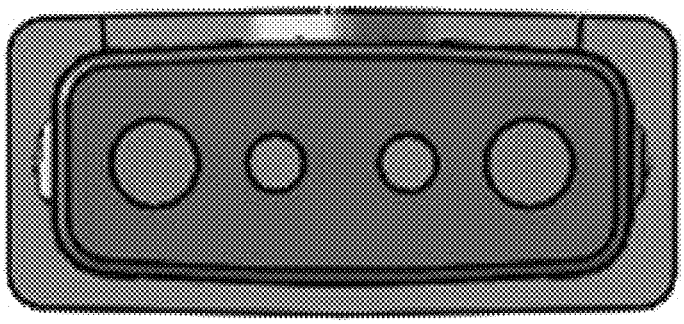

A further embodiment may include magnets being place where traditionally air holes would be placed, in case the airflow path is created by side air inlets. In this embodiment, the magnets would look (for example as shown in FIG. 2D).

Figure 3:
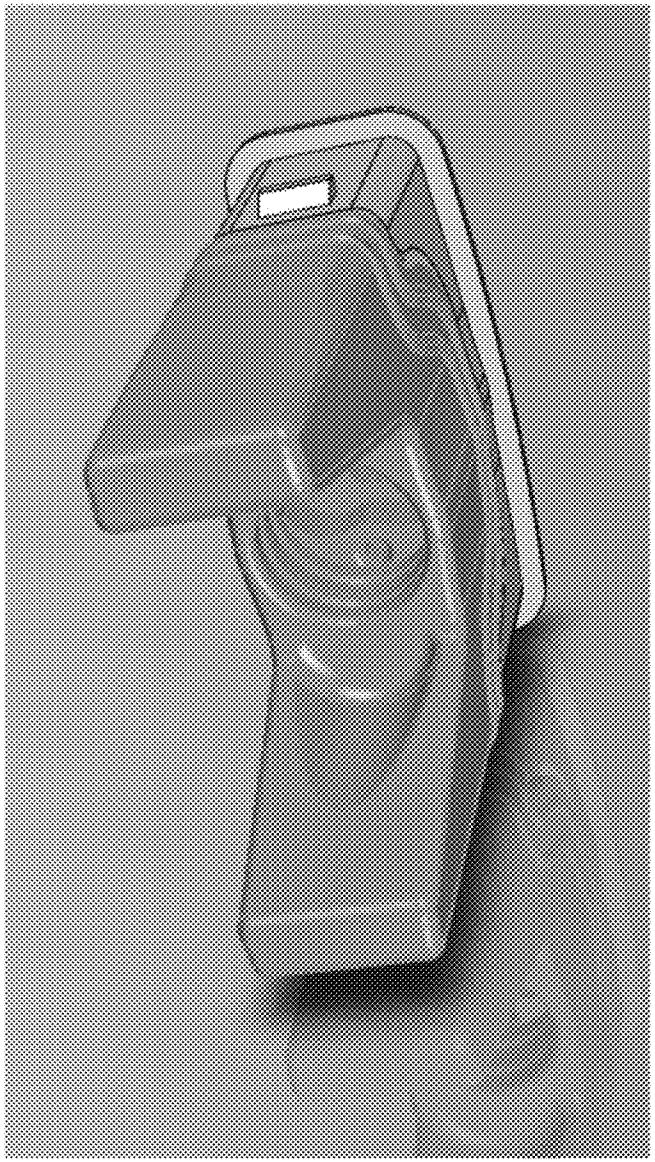
FIG. 3 illustrates a funneling seal of the vaporizer cartridge according to aspects of the present disclosure.

The liquid funnel acts as funneling the liquid held in the vaporizer cartridge towards the heating chamber. This piece naturally assists the liquid flow of the liquid towards the heating element and thus allows all liquid to be used. This construction eliminates pools of liquid in dead spaces or cannot be funneled to the heating element. (see, e.g., FIG. 3).

Figure 4A:
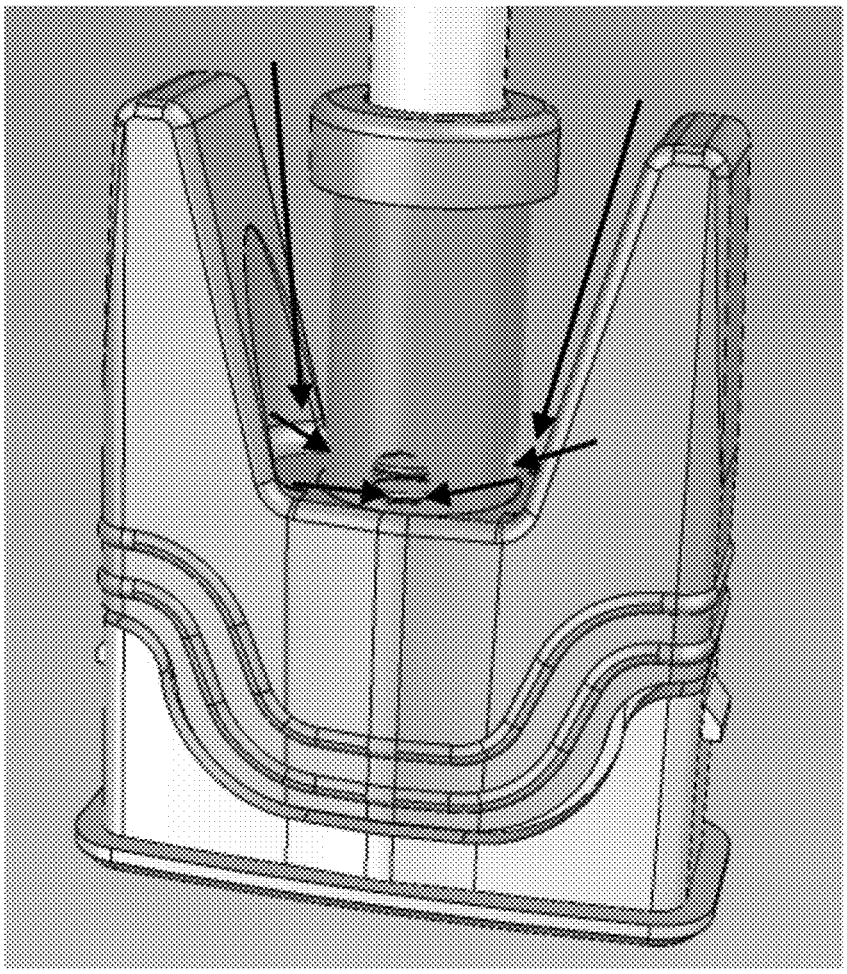
FIGS. 4A-4D illustrate several internal components of the vaporizer cartridge according to aspects of the present disclosure.
Figure 4B:
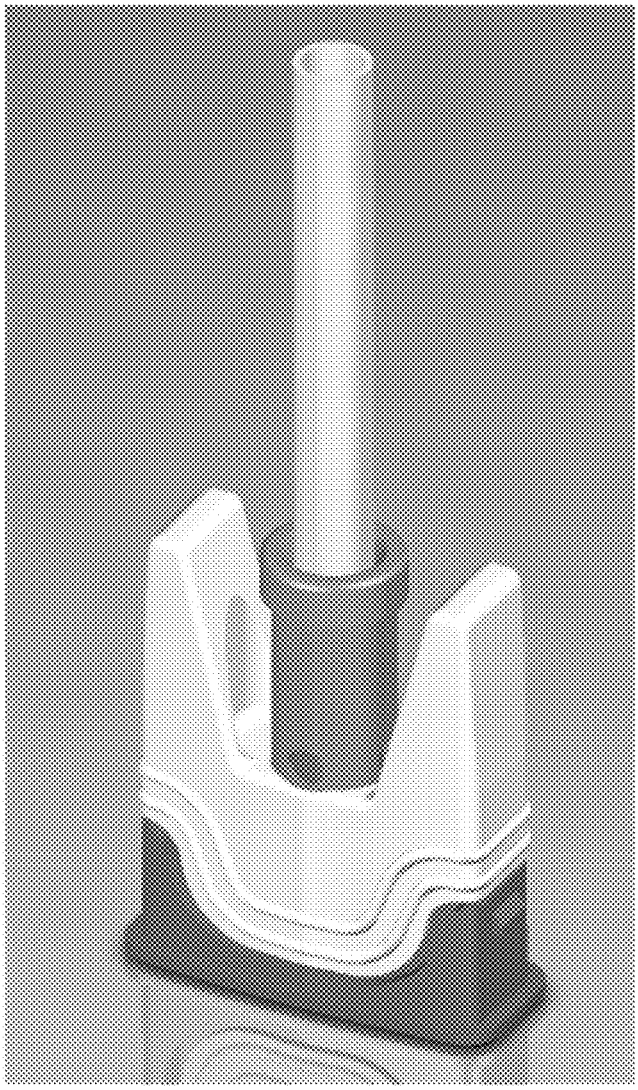
Figure 4C:
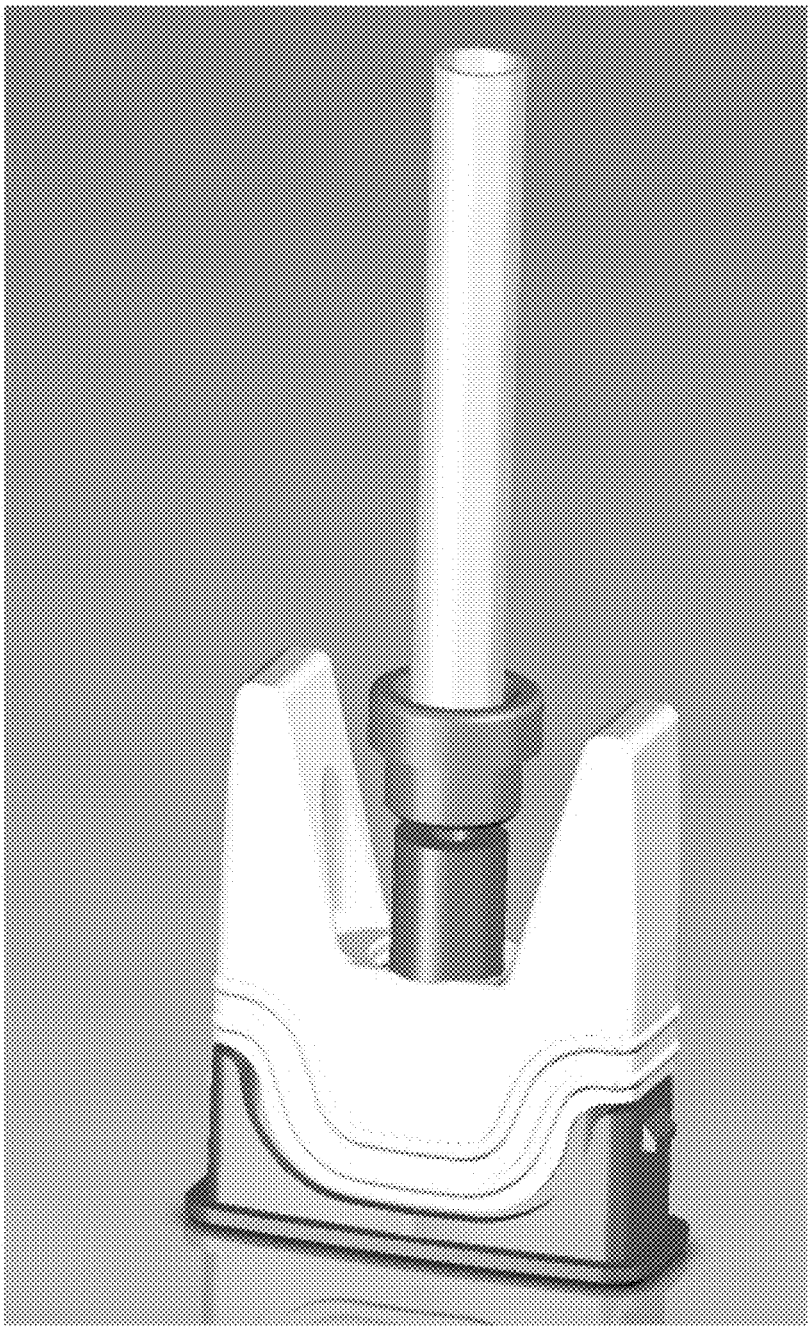

Further, the liquid funnel acts as a seal that controls the flow of liquid from the reservoir to the chamber, minimizing the likelihood that liquids overflow the chamber or that liquid seeps into the vapor tube. This feature supports the regulation of wicking capabilities. The funnel guides the liquid to the heating element, which may be a traditional wick made of cotton, silica, wood-fiber, etc, or ceramic materials, and is housed in the heating chamber. The traditional wick made of cotton or silica may be wrapped around a coil such as nichrome, kanthal, stainless steel, etc, or on the inside of the coil, encased by the heating wires, the latter of which is described in FIG. 4A. FIG. 4A does not show the cotton wick, just the heating wires for illustrative purposes. Further, the ceramic element may be wrapped with cotton to improve wicking functionality, or may be made of porous material that does not require a wrapped wick. An embodiment of the ceramic heating element without cotton is shown in FIG. 4B (fit into heating chamber) and 4C (without the heating chamber). The ceramic heating element may have a partly hollow interior to allow airflow to travel towards the heating chamber, may provide a sufficiently porous material for the airflow to flow through it, or may provide for airflow going past any of the sides of it. The shape of the ceramic heating element may be elliptical, square, or irregularly shaped. The heating chamber may have 1 or more fluid inlets. The fluid inlets may be varied in size, number, and placement to a variety of liquid viscosities. In particular with ceramic materials, the funneling function of this construction aids transporting the liquid to fluid inlets of the heating chamber. Further embodiments using the above parts may be used as well.

Figure 4D:
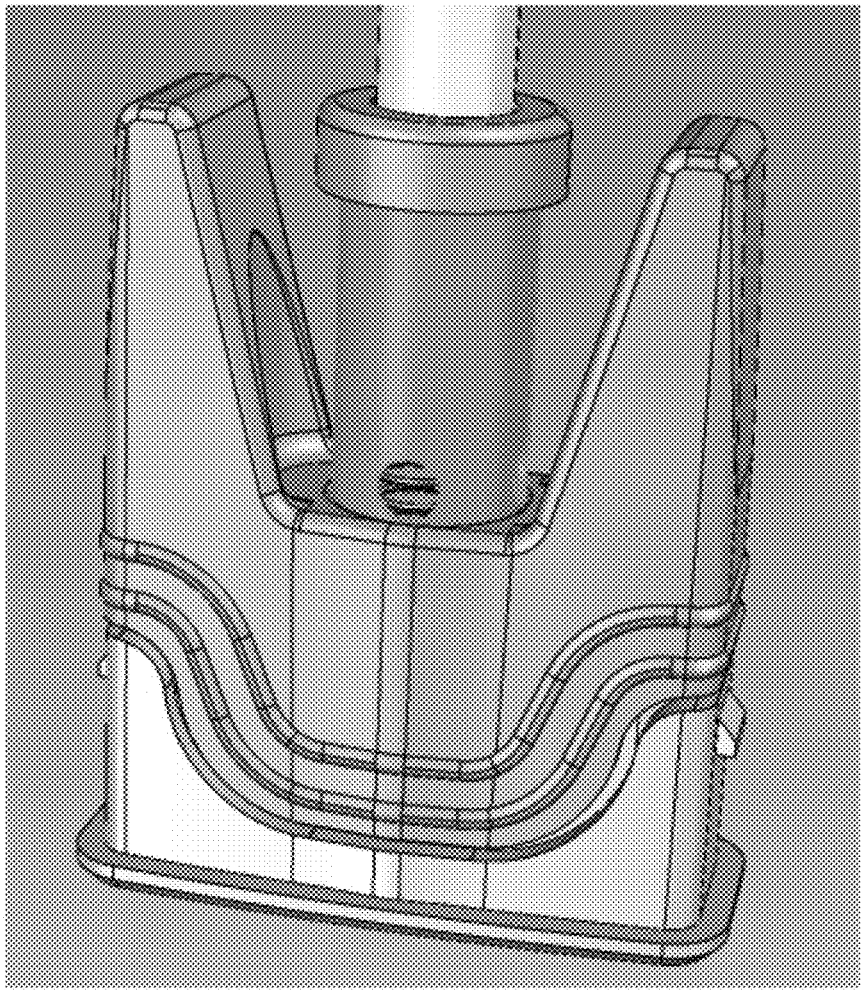
Figure 5:
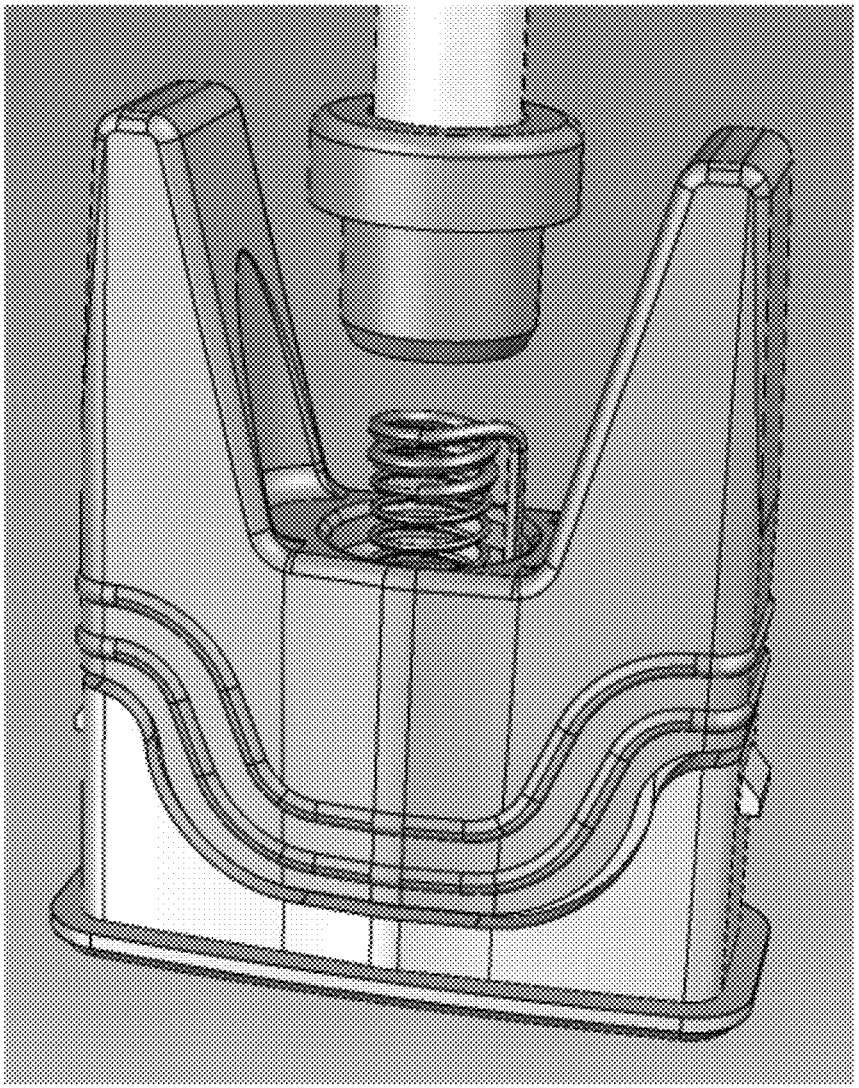
FIG. 5 provides an exploded diagram illustrating a heating coil employed in a vaporizer cartridge according to aspects of the present disclosure.

In addition, a seal between the vapor tube and the heating chamber reduces the likelihood that excess liquid re-emerges from the heating chamber through the vapor tube and out of the cartridge. Items highlighted in turquoise can be made from a variety of materials, including but not limited to plastic or silicone. (see, e.g., FIGS. 4D and 5).

Figure 6:
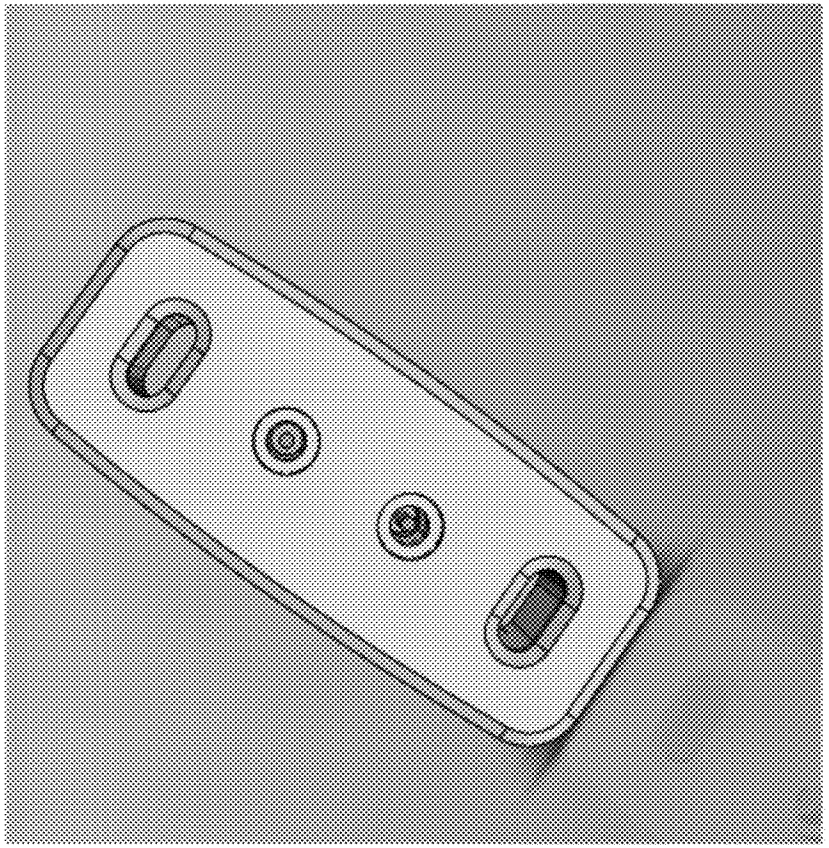
FIG. 6 provides a bottom view of a vaporizer cartridge according to aspects of the present disclosure.
Figure 7:
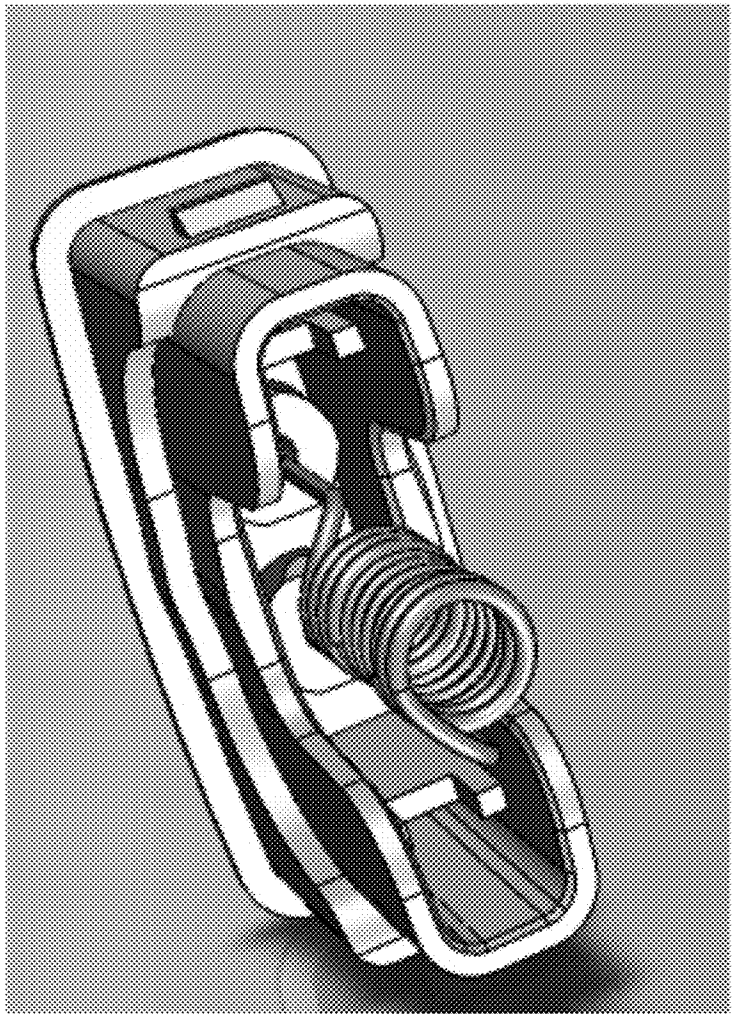
FIG. 7 illustrates a heating coil and cap of a vaporizer cartridge according to aspects of the present disclosure.
Figure 8:
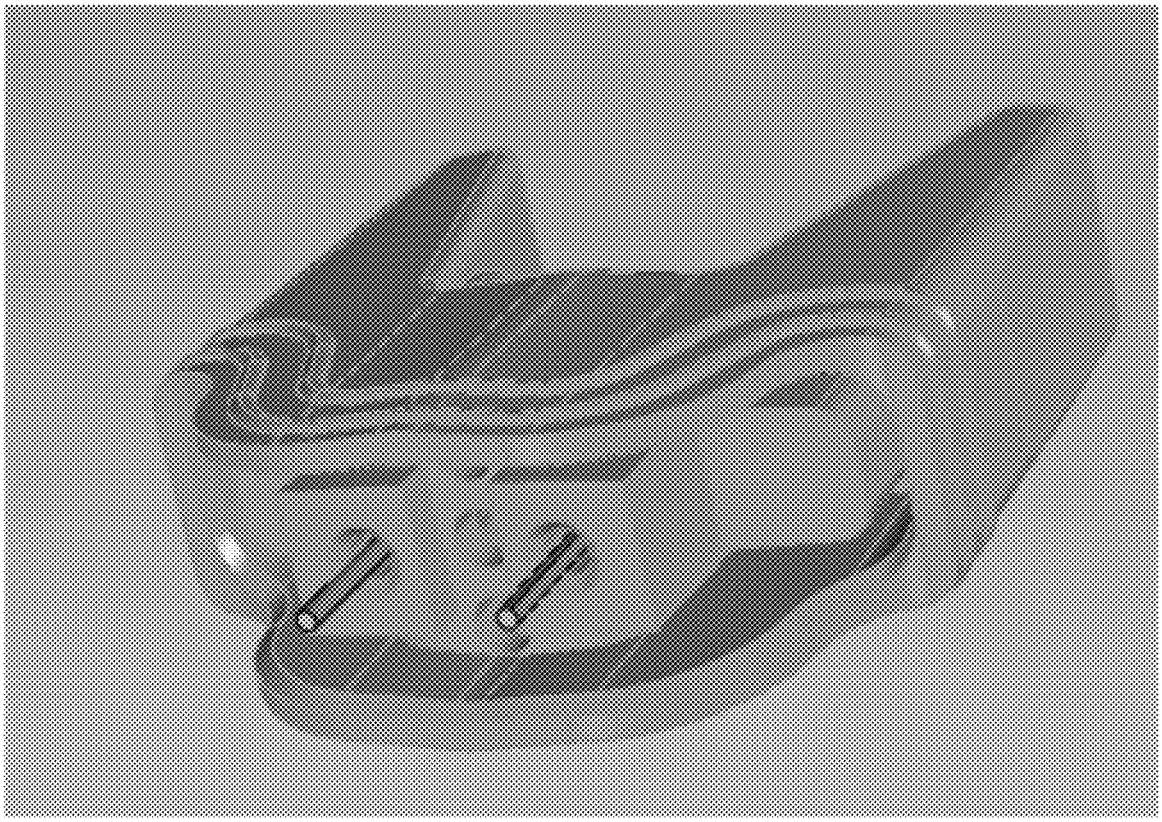
FIG. 8 illustrates a funneling seal of vaporizer cartridge according to aspects of the present disclosure.
Figure 9:
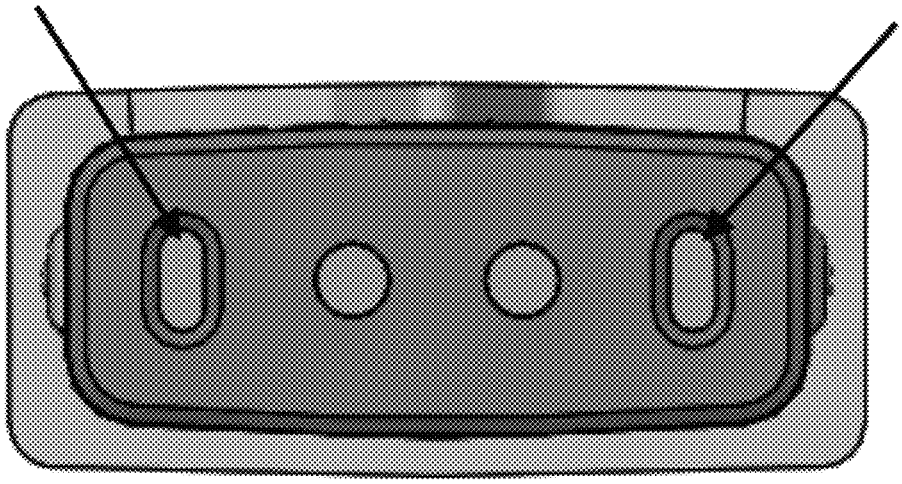
FIG. 9 illustrates a bottom view of a vaporizer cartridge according to aspects of the present disclosure.
Figure 10:
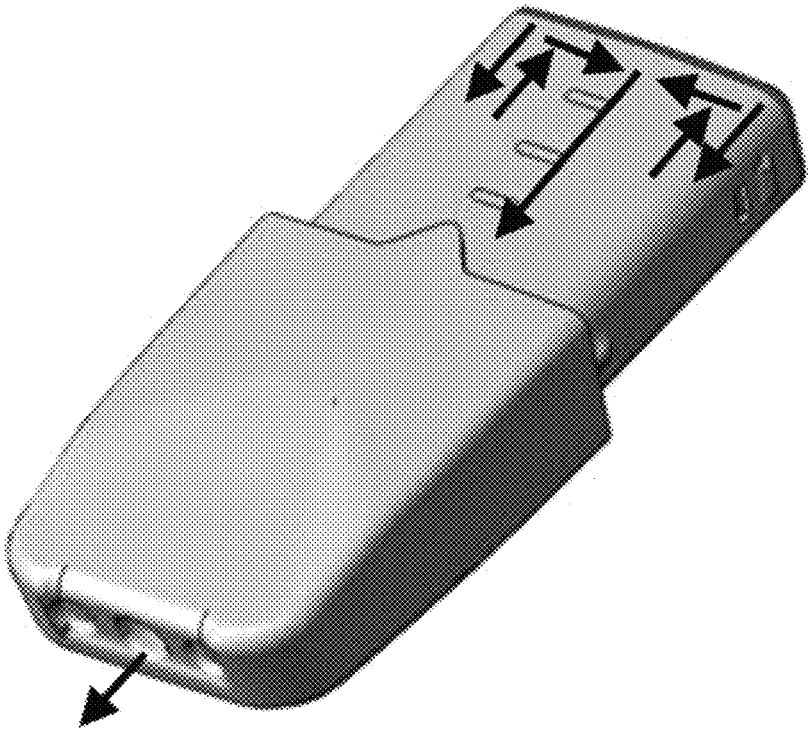
FIG. 10 illustrates an air flow path for a vaporizer cartridge according to aspects of the present disclosure.

At the mating region of the pod at the bottom part to housing, our invention includes two air holes and a place where the two pins (not shown in FIG. 6 but FIG. 9) are inserted to conduct electricity. The two air holes serve as air inlets from the bottom of the cartridge. The airflow is such that air travels up the air inlets north. (FIG. 6) However, instead of the airflow going straight from the two air inlets to the heating region, the airflow is guided from the air inlets into the pod, and then hits the underside of the funnel seal. (FIG. 8) The airflow is then guided by the opening created by combining the funnel seal and the bottom part, thereby traveling south and to the center. (FIG. 7) Thus, air from both inlets meets underneath the heating element, before being passed through to the heating element. This "torturous path" of the airflow makes it less likely for liquid to leak from the heating element into the cartridge receptacle. The airflow is illustrated in FIG. 9 and FIG. 10. An embodiment of this is the airflow coming from side air inlets of the pod, either above or below the stabilizer, instead of air inlets from the bottom of the pod. This is further described below.

In accordance with aspects of the present disclosure, side airholes may be used instead of bottom airholes. The side airhole would still allow the air to enter the cartridge, with a similar torturous path to the bottom airhole. The function of the side airholes are facilitated by the stabilizer design that positions the side walls away from the interior side walls of the device, and creates an air gap between the cartridge and the side walls of the receptacle. The side inlet would have the additional benefit to increase space available for the magnetic connection at the bottom, as well allow other information to be placed there to identify the cartridge (e.g. barcode, RMD resistor, etc.) (see, e.g., FIG. 11). The airflow is further illustrated in FIG. 12.

Figure 12:
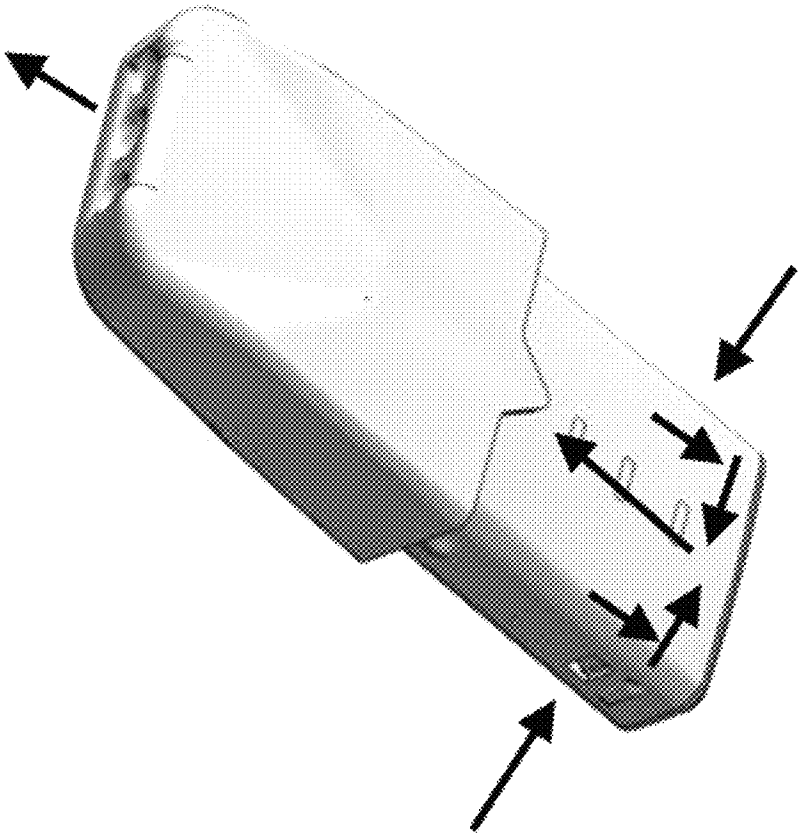
FIG. 12 illustrates another air flow path for a vaporizer cartridge according to aspects of the present disclosure.
Figure 13:
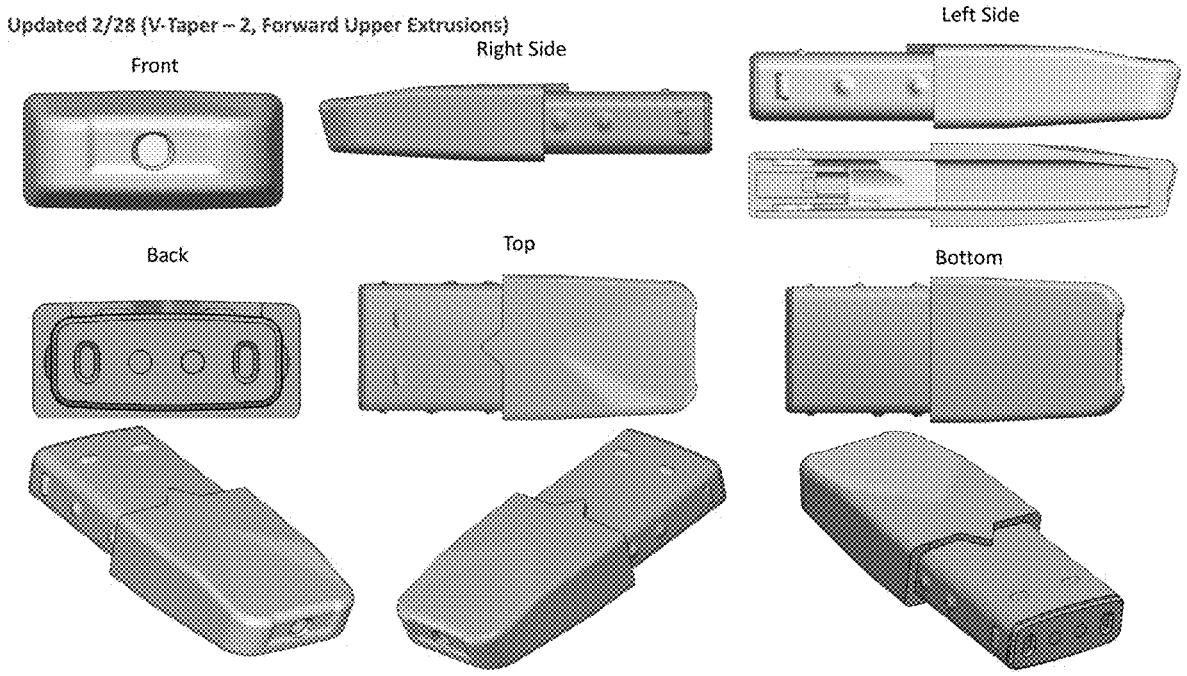
FIG. 13 illustrates orthographic and perspective views of a vaporizer cartridge according to aspects of the present disclosure.
Figure 14:
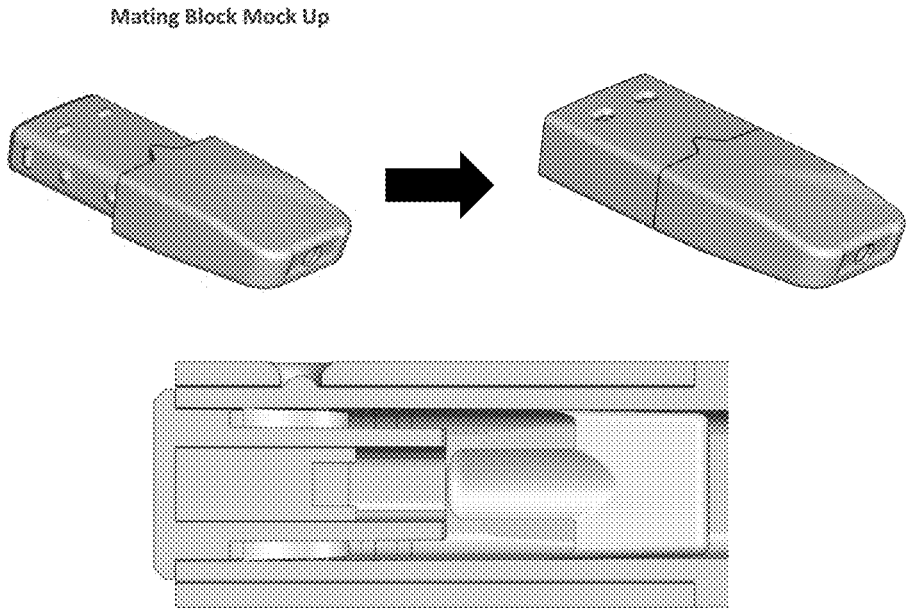
FIG. 14 illustrates a cutaway view of a vaporizer cartridge according to aspects of the present disclosure.
Figure 15:
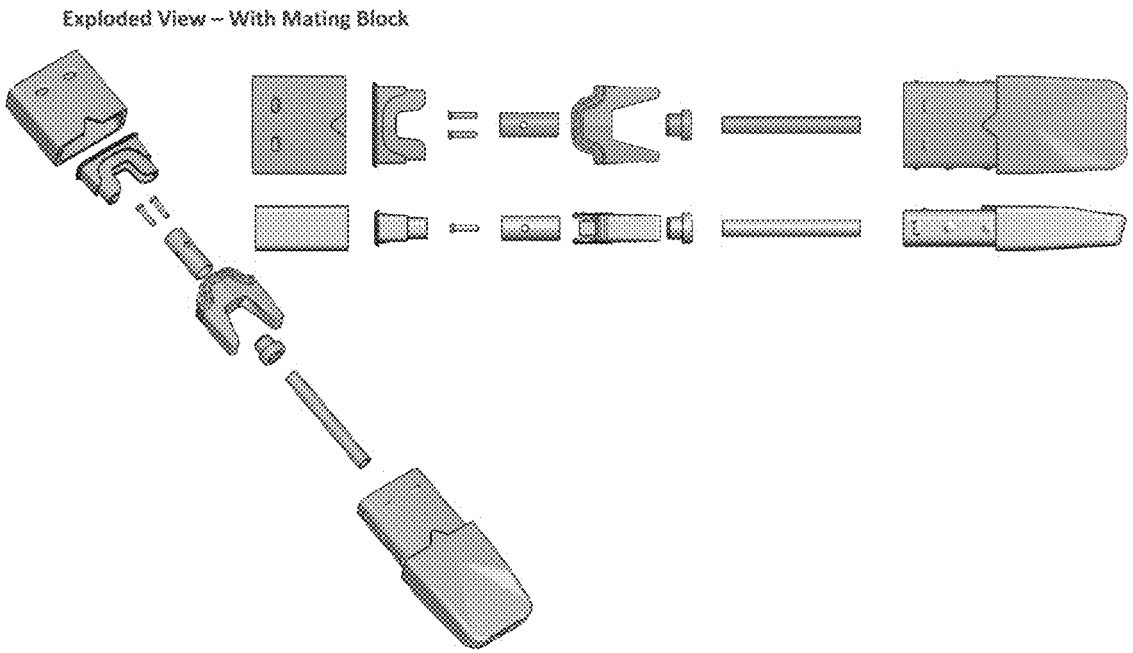
FIG. 15 illustrates exploded views of a vaporizer cartridge according to aspects of the present disclosure.
Figure 16A:
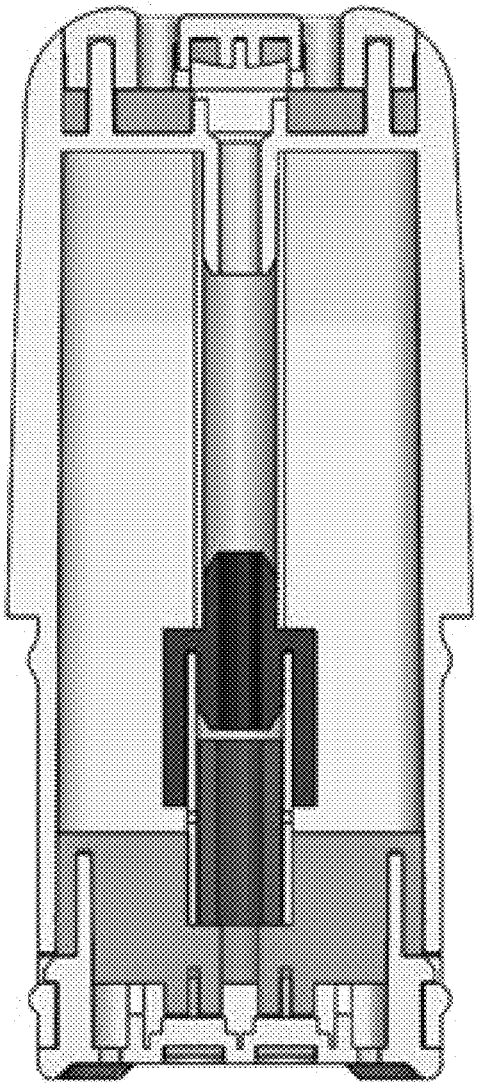
FIGS. 16A-16C illustrate another air flow path for a vaporizer cartridge according to aspects of the present disclosure.
Figure 16B:
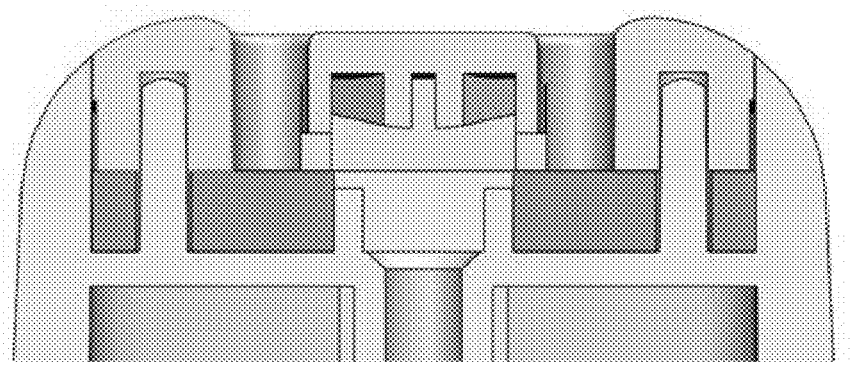
Figure 16C:
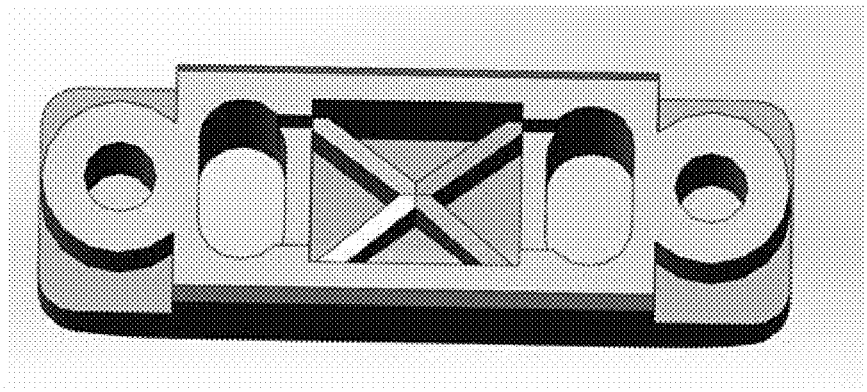

FIGS. 10 and 12 further show the three apertures at the top of the cartridge; these can also be provided in any other alternate configuration (e.g. 2 or 4 apertures, or apertures at different intervals, or apertures placed at different locations). The function of these apertures includes guidance to the user for the correct insertion of the cartridge into the battery receptacle. Further, it stabilizes the cartridge vis a vis the mating region on the top side. Further, these apertures may also function in creating sufficient space for airholes to be placed on that side instead of or in addition to the side or bottom air inlets. In this configuration, a torturous path can alternatively or in addition be added to the airway in proximity to the mouthpiece at the top of the cartridge. See, for example, FIGS. 16A-16C, which illustrate an exemplary cap inserted at the tip of the mouthpiece to divert the central airway directing aerosols from the heating chamber to two apertures of the mouthpiece. To provide additional filtration and/or limit fluid leakage, by way of example as illustrated in FIGS. 16A-16C, the pathways in the mouthpiece just below the cap include chambers for receiving a filter material (for example, cotton).

The exterior cartridge housing is preferably molded in one piece with a matte black see-through finish. This allows the user to view the liquid fill volume from all angles or during use, while remaining discrete. This gives the user the ability to have visibility into the liquid fill level, being able to determine if the cartridge is full or close to run out without having to take the cartridge out of the battery receptacle or without having to create the need for a viewing window or notch. The preferred cartridge material provides a matte black translucent finish that enables a liquid fill level to be visually determined by a user. There are multiple suitable plastic materials, including but not limited to PCTG (Poly Cyclohexylenedimethylene Terephthalate, glycol-modified). Other translucent materials, as well as perhaps clear finish materials, may also be suitable.

Figure 11:
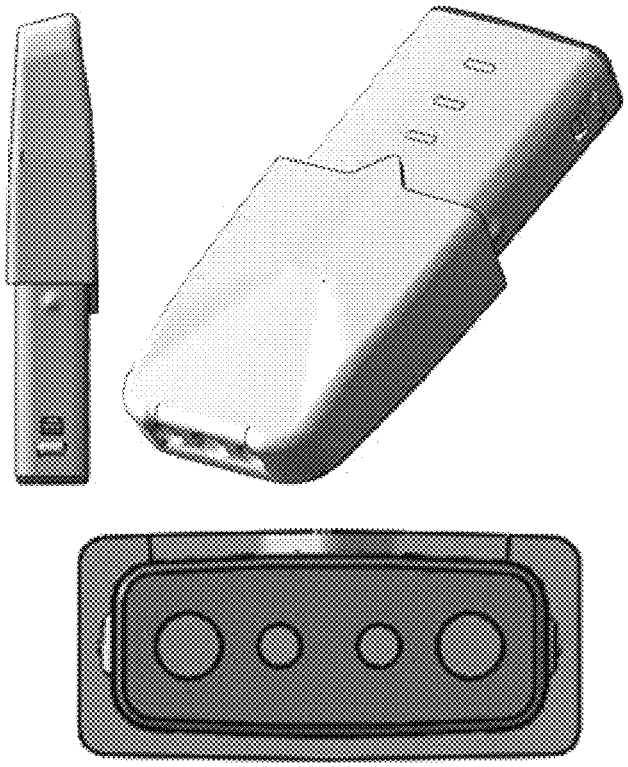
FIG. 11 illustrates several views of a vaporizer cartridge according to aspects of the present disclosure.

According to aspects of the present disclosure, the cartridge mouthpiece is configured with novel ergonomic from features including tapering on one side and an elongated tip on the other side (see, e.g., FIG. 11). This construction allows the user to more comfortably place the cartridge on the lips.

It will be understood that, while various aspects of the present disclosure have been illustrated and described by way of example, the invention claimed herein is not limited thereto, but may be otherwise variously embodied within the scope of the following claims. For example, while the exemplary embodiments herein are directed to a vaporizer cartridge with an insertable portion of the housing having a rectangular cross-section, aspects of the disclosure are not be be interpreted as limited to this exemplary configuration. For example, the vaporizer could be constructed with the inserted portion of the housing having a circular, elliptical, hexagonal, pentagonal or octagonal cross-section, as well as any other geometric or non-geometric shape that would effectively mate with the battery receptacle.

We claim:

1. A cartridge insertable into a vaporizer device, the cartridge comprising:

a body including a storage compartment configured to hold a vaporizable material, the body having a first end and a second end opposite the first end, the body having a mouthpiece positioned at the first end and the second end being configured for insertion into a receptacle of the vaporizer device;

a heating chamber including a heating element configured to vaporize the vaporizable material;

a vapor tube extending between the heating element and the mouthpiece;

a seal insertable at the second end within the storage compartment of the body, the seal configured to retain the vaporizable material within the storage compartment and including a well for retaining the heating element and interior surfaces inclined from a distal end of the seal toward the well for funneling the flow of the vaporizable material within the storage compartment towards the well; and a cap insertable at the second end for retaining the seal within the storage compartment.

2. The cartridge of claim 1, wherein the heating element comprises a wick.

3. The cartridge of claim 1, further comprising a vapor tube seal for sealably joining the heating element and the vapor tube.

4. The cartridge of claim 1, further comprising a pair of contact pins in electrical communication with the heating element and sealably extending externally from the cartridge through ports in the seal and cap.

5. The cartridge of claim 1, wherein:

the second end of the body has a rectangular cross-section externally bounded by two opposing side surfaces, a front surface and a rear surface;

each of the two opposing side surfaces further comprises a stabilizing extrusion extending outwardly from the surface at a proximal end of the second end of the body;

at least one of the front surface or rear surface has a plurality of stabilizing extrusions extending outwardly from the front or rear surface; and the stabilizing extrusions are configured for stably positioning the body in the receptacle of the vaporizer device.

6. The cartridge of claim 5, wherein each of the two opposing side surfaces further comprise an additional stabilizing extrusion extending outwardly from the surface at a distal end of the second end of the body.

7. The cartridge of claim 5, wherein:

each of the two opposing side surfaces further comprise an air hole located between the stabilizing extrusion and a distal end of the second end of the body, the air hole being in fluid communication with a first airway, the first airway further being in fluid communication with the heating chamber; and the stabilizing extrusions are each configured for maintaining a second airway between the body and one or more interior surfaces of the receptacle of the vaporizer device when the body is inserted into the device.

8. The cartridge of claim 7, wherein a path defined for each of the first airways is a torturous path.

9. The cartridge of claim 1, further comprising one or more magnets fixedly positioned at a bottom surface of the cap.

10. The cartridge of claim 1, further comprising:

one or more air holes located at a bottom surface of the cap, in fluid communication with one or more airways extending through the cap and seal, the one or more airways further being in fluid communication with the heating chamber.

11. The cartridge of claim 10, further comprising one or more magnets fixedly positioned at a bottom surface of the cap.

12. The cartridge of claim 11, wherein the one or more magnets are ring-shaped magnets each positioned to surround one of the one or more air holes.

13. The cartridge of claim 1, wherein the first and second ends of the body are formed as a one- piece PCTG molding.

14. The cartridge of claim 1, wherein the PCTG molding is a matte black translucent molding.

* * * * *